US009236175B2

(12) United States Patent
Thode et al.

(10) Patent No.: US 9,236,175 B2
(45) Date of Patent: Jan. 12, 2016

(54) ELECTROMAGNETIC ACTUATION DEVICE

(75) Inventors: Oliver Thode, Stockach-Wahlwies (DE); Viktor Raff, Radolfzell (DE)

(73) Assignee: ETO Magnetic GmbH, Stockach (DE)

( * ) Notice: Subject to any disclaimer, the term of this patent is extended or adjusted under 35 U.S.C. 154(b) by 0 days.

(21) Appl. No.: 13/880,543

(22) PCT Filed: Oct. 20, 2011

(86) PCT No.: PCT/EP2011/068380

§ 371 (c)(1),
(2), (4) Date: Jun. 26, 2013

(87) PCT Pub. No.: WO2012/052528

PCT Pub. Date: Apr. 26, 2012

(65) Prior Publication Data

US 2013/0265125 A1 Oct. 10, 2013

(30) Foreign Application Priority Data

Oct. 20, 2010 (DE) ..... 10 2010 048 808

(51) Int. Cl.

| | |
|---|---|
| ***H01F 3/00*** | (2006.01) |
| ***H01F 7/08*** | (2006.01) |
| ***H01F 7/121*** | (2006.01) |
| ***H01F 7/13*** | (2006.01) |

(52) U.S. Cl.

CPC ..... *H01F 7/121* (2013.01); *H01F 7/081* (2013.01); *H01F 7/13* (2013.01)

(58) Field of Classification Search

CPC ..... H01F 7/13; H01F 7/1607; H01F 7/081; H01F 2007/086; H01F 3/14

USPC ..... 335/220–229, 255, 262, 279

See application file for complete search history.

(56) References Cited

U.S. PATENT DOCUMENTS

| | | | | |
|---|---|---|---|---|
| 4,419,643 | A * | 12/1983 | Ojima et al. | 335/234 |
| 5,066,980 | A | 11/1991 | Schweizer | |
| 6,392,516 | B1 | 5/2002 | Ward et al. | |
| 6,615,780 | B1 * | 9/2003 | Lin et al. | 123/90.17 |
| 7,280,021 | B2 * | 10/2007 | Nagasaki | 335/255 |
| 7,626,288 | B2 * | 12/2009 | Protze | 335/209 |
| 7,688,169 | B2 | 3/2010 | Zhao | |
| 7,876,187 | B2 * | 1/2011 | Gibson et al. | 335/279 |
| 2002/0060620 | A1 | 5/2002 | Bircann et al. | |
| 2009/0051471 | A1 | 2/2009 | Zhao | |

FOREIGN PATENT DOCUMENTS

| | | |
|---|---|---|
| CN | 101185229 | 5/2008 |
| DE | 3829676 A1 | 3/1990 |

(Continued)

OTHER PUBLICATIONS

Chinese Office action dated May 4, 2015.

*Primary Examiner* — Bernard Rojas
(74) *Attorney, Agent, or Firm* — Bachman & LaPointe, PC

(57) ABSTRACT

An electromagnetic actuating apparatus having an armature unit, which can be moved through a movement distance in an axial direction relative to a stationary core unit and in reaction to an operating current being passed through a coil unit, which armature unit magnetically interacts axially at one end with the core unit over a control range which at least partially overlaps axially along the movement distance, which, as a section of the armature unit, has a first profile section and, as a section of the core unit, has a second profile section, with an air gap formed between them and forms an extent at right angles to the axial direction.

14 Claims, 2 Drawing Sheets

(56) References Cited

FOREIGN PATENT DOCUMENTS

| | | | |
|---|---|---|---|
| DE | 19848919 | A1 | 4/2000 |
| DE | 10251851 | A1 | 2/2004 |
| DE | 102008034609 | A1 | 2/2010 |
| EP | 1887677 | | 2/2008 |
| JP | 2001135520 | A | 5/2001 |

* cited by examiner

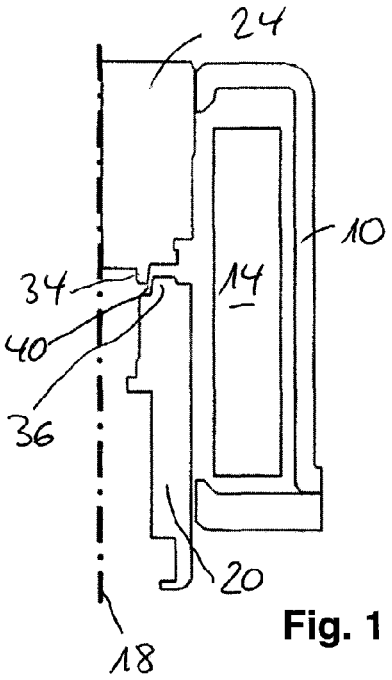
Fig. 1
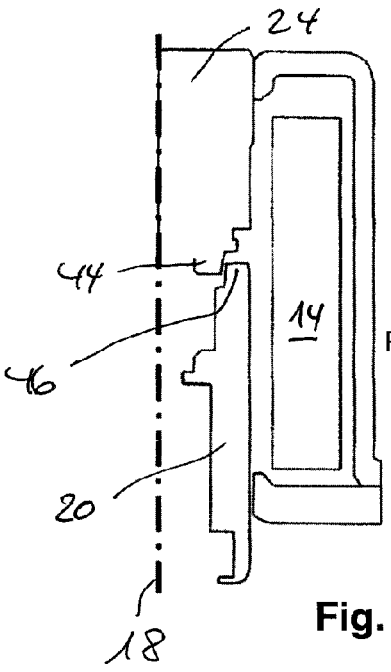
PRIOR ART
Fig. 4
Fig. 3
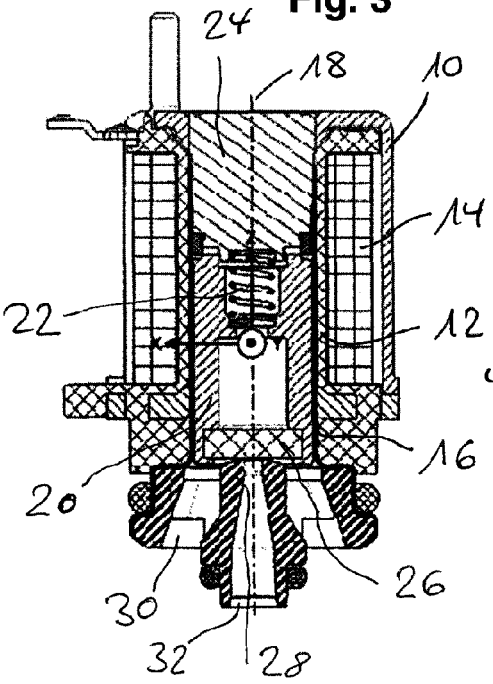
Fig. 2
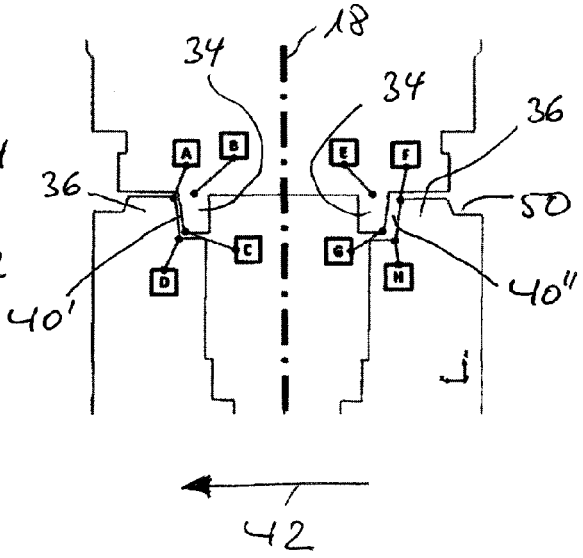

ELECTROMAGNETIC ACTUATION DEVICE

BACKGROUND OF THE INVENTION

The present invention concerns an electromagnetic actuation device.

Such a device is, for example, of known art from DE 198 48 919 A1 as an electromagnetic valve device. As a reaction to the energisation of a (stationary) coil unit, an armature unit, guided in a radially symmetrical manner in the interior of the coil, moves and opens or closes a valve seat for the fluid that is to be controlled.

Here the armature unit (essentially having a cylindrical armature body) moves along the axial direction relative to a stationary core unit, which is part of the magnetic circuit, and which by means of its configuration influences the movement characteristic, in particular a magnetic armature force of the armature unit. In concrete terms the device cited as prior art features a so-called control cone region (control region) for purposes of influencing the movement characteristic, i.e. the force profile, of the armature movement in the crossover region between the (movable) armature unit and the (stationary) core unit; the said control cone region influences the magnetic flux in the magnetic circuit between armature unit, core unit, and the other magnetic circuit elements that are involved, along the axial direction, in a region of the armature stroke (namely the region immediately after the release of the armature unit from the core unit).

The control cone of known art from DE 198 48 919 A1, here in the form of an annular step, running around the periphery of the armature end face, and flattened outboard, and a corresponding (radial) inner form on the side of the core unit, here effects, for example, an increase of the magnetic force of the armature in the initial stroke region described. As a result of the overlap shown between the armature unit and the core region the necessary magnetomotive force of core and armature reduces as a result of energisation of the coil, relative to that for a so-called flat cone, namely a configuration of the crossover region between armature unit and core unit with no axial overlap, i.e. with no reduction of the working air gap. Accordingly the magnetic field lines of the magnetic flux over the axial overlap are primarily closed, as a consequence of which the magnetic force in this armature initial stroke region is specifically increased.

By means of a suitable configuration of the said control region (control cone region), for example, specification of an effective axial overlap, it is possible to influence specifically the movement characteristic of the armature unit, in particular a profile of the magnetic force along the movement stroke (movement stroke path); to reinforce or weaken, for example, the profile comparatively or point-by-point.

However, the axial overlap of armature unit and control unit in the control region, which is to be taken to be of known art, also brings with it potential disadvantages, in particular in terms of the wear and service life properties of electromagnetic actuation devices configured in this manner. Thus in particular, as a result of the axial overlap of the profile sections on the armature and core forming the control region, in addition to the axial magnetic flux profile that is important for the armature movement, there also arises a radial component (i.e. a component normal to the axial direction) of the magnetic flux profile, across the air gap formed between the facing walls of the profile sections. The said magnetic force component (which is radial in radially symmetrical arrangements) causes disadvantageous transverse forces, which have a disadvantageous effect in practice, i.e. in particular in conjunction with frequent movement cycles, or long operating times.

It is true to say that if the armature and core were to be exactly aligned relative to one another, the transverse force generated by the radial magnetic force component would be cancelled out in the centre and thus compensation would be effected. However, this cannot be achieved in practice, either in production, or in operation. Instead the effect can be observed that the armature unit (necessarily mounted with a radial clearance) within a surrounding guide has a tendency to tilt (within the bounds of the clearance that is present), whereby such an effect is, for example, additionally reinforced by compression springs that are not engaging quite centrally with the armature unit, or similar influences; production tolerances and other effects also play a role.

An armature unit of this kind, sitting within the bounds of the clearance fit in an inclined manner in the armature guide (in the form of a diametrical two-point contact on corresponding internal positions of the armature guide) leads firstly to the fact that core unit and armature unit (and consequently the profile sections forming the control region) are no longer exactly aligned, thus large radial air gaps of various sizes (more specifically: sectors of a peripheral air gap) appear around the periphery.

With energisation of the coil unit and the magnetomotive force in the control region thereby caused large magnetic transverse forces of unequal size accordingly arise in the air gap positions of various widths. Small radial air gaps generate relatively high magnetic transverse forces, while large radial air gaps correspondingly generate small magnetic transverse forces. These no longer compensate for each other in the radial direction, so that a resultant (radial) transverse force is formed in the direction of the smallest air gap.

This acts on the armature unit (mounted with clearance) as a normal force and generates static and sliding friction forces in accordance with the frictional values of the tribological system comprising the armature unit (or an armature sliding coating provided on the armature unit) and also the armature guide.

In the first instance these act negatively on the force balance of the magnet and lead to an (unnecessary) increase in the magnetic force requirement, and consequently to a larger magnet installation space.

In electromagnetic switching devices with a high service life requirement (typically more than 100 million switching cycles) the high magnetic transverse forces (normal forces) described also generate a disadvantageously high surface pressure onto the friction partners, and thereby accelerate their tribological wear. This is particularly serious, for example, in the case of pneumatic actuation applications (such as, for example, a pneumatic valve) since here no lubrication or similar can act so as to reduce the wear.

The consequence is premature failure, in particular in the case of systems with a control cone region optimised in terms of build size and energy consumption, in particular if the armature unit, in a manner otherwise of known art, is provided with sliding coatings of PTFE or $MoS_2$ and no sliding film (itself, however, again complex) is used for purposes of guiding the armature.

It is therefore the object of the present invention to improve an electromagnetic actuation device of the generic kind in terms of its operational and wear characteristics, in particular to reduce disadvantageous transverse, i.e. normal forces, which promote tilting of the armature unit, and thus within the context of systems having an axially overlapping control region to combine a beneficial magnetic movement characteristic and energy optimisation with protection against undesirable wear as a result of disadvantageous friction.

SUMMARY OF THE INVENTION

The object is achieved by means of the electromagnetic actuation device wherein the control region (control cone region) between the armature unit and the core unit is equipped, by the configuration of the (magnetic) effective flux cross-sections of the first and second profile sections, such that with the usual operating current for the coil unit, effecting the movement of the armature unit, a flux and force compensation is achieved in the form of a regulatory effect. More specifically, the profile sections are configured in accordance with the invention such that in the event of tilting, i.e. deflection, in a first region of the related (radial) air gap, the increased transverse force (normal force) is compensated for, in that for a related magnetic flux (magnetomotive force), increased in accordance with the reduced air gap, a magnetic resistance increases in this region. Typically the profile sections with regard to their effective flux material cross-sections are thereby configured such that in an accordingly tilted state of the armature unit saturation occurs in the (radial) narrow region of the air gap as a result of the increased magnetomotive force generated there; thus an effective flux magnetic resistance arises, which causes the magnetomotive force to be moved (back), i.e. displaced, to other regions of the air gap. This has an action that directly reduces the disadvantageous normal force, i.e. transverse force, with the advantageous consequence of lower friction, correspondingly lower energy consumption and reduced wear.

In the context of the radially symmetrical systems that are preferably to be deployed (i.e. an armature unit is guided within a coil unit that surrounds the latter, whereby on the end faces of both armature unit and core unit are formed the respective profile sections in the form of elevations or depressions running around the peripheries) the inventive principle ensures that with conventional operating currents for the coil unit providing typical movements, an effective displacement of the magnetic flux promoting the transverse force takes place from the region of the shortest air gap into other regions, since the magnetic saturation action—in an appropriately compensatory manner—offers a higher magnetic resistance.

Thus the inventive principle can be implemented in terms of a suitable configuration of the profile sections, which then, adapted to the magnetomotive force that is to be anticipated in typical operating conditions, are configured such that with a radially facing minimised air gap they specifically experience an increase (or saturation) of the magnetic flux resistance.

Thus it is appropriate to give to the first and/or second profile sections in longitudinal section a tooth or cam profile (with conical angles of inclination suitable for development); in the case of the advantageous radially symmetrical design these are appropriately formed as annular projections (i.e. interact with a correspondingly adapted annular groove). Here a particular requirement is accordingly to be optimised, whereby, for example, flat cone angles possess the advantage of inherently lower transverse forces, but with these the effective region of axial overlap also becomes smaller at the same time.

In general it is moreover advantageous to configure the respective cone angles of wall sections of the profile sections inclined relative to the central axis such that they run parallel to one another (with reference to a non-tilted, i.e. non-deflected, central position of the armature unit), that is to say, they have the same angle (i.e. within the context of production tolerances, the maximum difference angle typically does not exceed 5').

An embodiment as a so-called inner cone has been demonstrated to be particularly advantageous. A narrow cone ring (as a second profile section) of the core unit, which as a result of its effective flux cross-sectional shape has a tendency to enter magnetic saturation at a lower magnetomotive force, protrudes into an inboard annular step (cone step) on the end face of the armature unit. As a result of the narrow conical annular step the related armature section reacts sensitively to alterations in the magnetomotive force and generates compensating magnetic forces (so as to restore a vertical position) in accordance with the above-described mechanism, these counteract the disadvantageous inclined position of the armature.

The result is that by means of the present invention disadvantageous friction between the armature unit and the armature guide is advantageously reduced, energy and magnetic forces are optimised, and wear is counteracted. In particular this is advantageous for practical implementation, with (conventional) PTFE or $MoS_2$ sliding coatings, of high service life requirements on electromagnetic actuation devices, for example valve devices, which achieve in the region of 100 million switching cycles or more, without the need for separate additionally complex measures. Thus in the context of the invention it is particularly advantageous and beneficial in terms of development that the (cylindrical) armature unit beneficially does not have to be guided in a sliding film for purposes of implementing a so-called sliding film bearing surface. Not only is the additional technical complexity in terms of components and production reduced (the application of such a sliding film also generates additional complexity on installation), the unnecessary increase of the parasitic air gap in the yoke region of the magnetic device as a result of a sliding film (more particularly, the thickness of the same) is also effectively avoided; such an increase would in turn have the disadvantage of a poorer magnetic efficiency.

In this manner the present invention is suitable in a beneficial manner, for example, for the implementation of valve devices, more preferably pneumatic valve devices, but is not limited to this field of application. Rather the advantage of the present invention can beneficially be used in all forms of implementation of electromagnetic actuation devices, in which—as determined by the design, i.e. clearance—tilting or deflection of the armature unit in an armature guide causes disadvantageous friction and wear, and profile elements that are already used in the control region (control cone region) so as to influence the magnetic force profile can be dimensioned and deployed so as to implement the inventively advantageous compensation behaviour.

BRIEF DESCRIPTION OF THE DRAWINGS

Further advantages, features, and details of the invention ensue from the following description of preferred examples of embodiment, and also from the figures; the latter show in:

FIG. 1 a schematic longitudinal half-section through the essential magnetic functional components of the electromagnetic actuation device in accordance with a first form of implementation of the invention;

FIG. 2 a detail view of the control region with the profile sections, facing one another, of the armature unit, i.e. of the core unit, and also measurement points plotted for a simulation;

FIG. 3 a longitudinal section view through a 2/2-way valve, implemented in terms of an electromagnetic actuation device for purposes of illustrating the application context of the present invention;

FIG. 4 a longitudinal half-section analogous to FIG. 1 to illustrate a configuration of the profile sections of the control region that is disadvantageous compared with the implementation of FIG. 1, and FIG. 5 a comparative diagram in the form of a force-path characteristic of the example of embodiment of FIG. 1, relative to the comparative example of FIG. 4.

DETAILED DESCRIPTION

Figure 5:
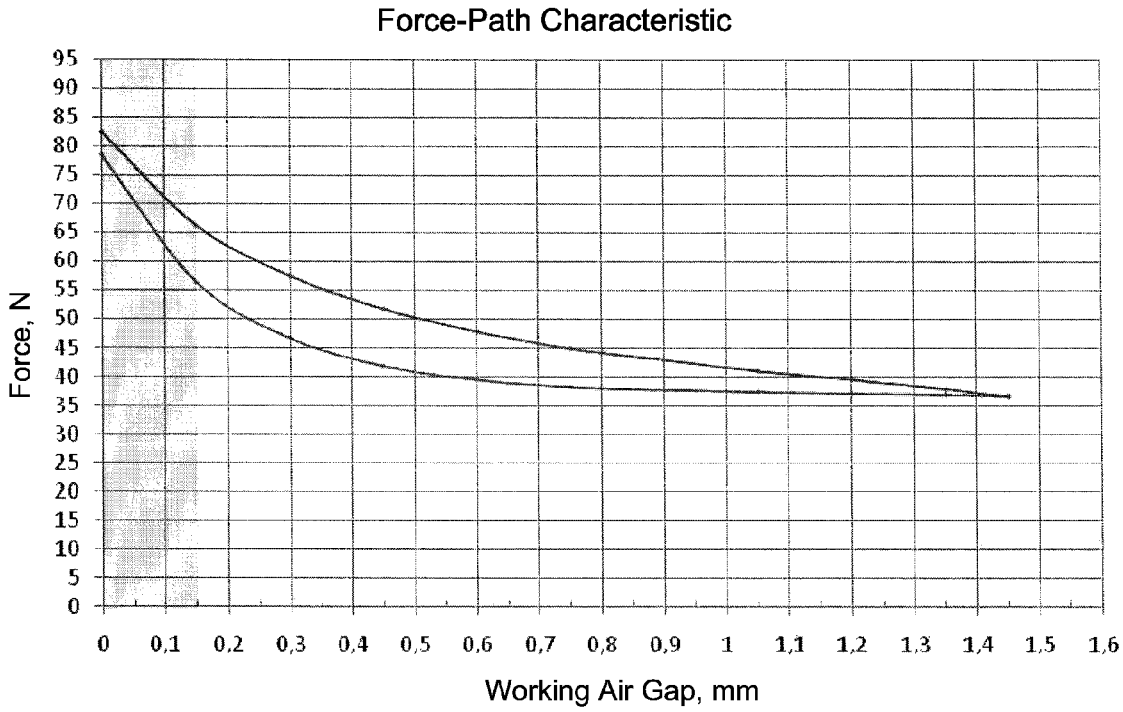

FIG. 3 illustrates the application context of the present invention; what is shown is a 2/2-way valve that in structural terms is otherwise of known art; this finds application in the motor vehicle sector and in the interaction between armature unit and cone unit is provided with a cone controller.

More specifically, the example of embodiment of FIG. 3, which with its features in the application context, outside the control region, should apply as pertinently disclosed in terms of the present invention, shows a housing 10 which carries a stationary winding 14 held on a coil carrier 12. Within the hollow cylindrical arrangement accommodating an armature guide tube 16, an armature unit 20 is guided along a longitudinal axis of movement 18, which has a cylindrical outer contour, is supported on a stationary core region 24 in the axial direction against the force of a compression spring 22, and opposite the core region 24, has a rubber valve insert 26, which is designed so as to close a valve seat 28, as a reaction to an axial movement of the armature unit 20. The valve action occurs between a supply port 30 and a working port 32. The peripheral surface of the armature unit 20 is provided in a manner otherwise of known art with a PTFE or $MoS_2$—antifriction coating; no antifriction film exists as a bearing surface for the armature unit.

As a reaction to an energisation of the winding 14 the armature unit 20 moves along the longitudinal axis of movement 18 in the vertical direction (Z in FIG. 3). The directions X, Y orthogonal to this axis are designated correspondingly.

A control region (control cone region) in the magnetic crossover region between the core unit 24 and the sectionally hollow cylindrical armature unit 20 is illustrated in the enlarged longitudinal half-section view of FIG. 1, while in a direct comparison, the example of embodiment of FIG. 4 shows a control region that has not been optimised and is not advantageous in terms of the invention.

In concrete terms in the preferred configuration of FIG. 1 the core region has an annular projection 34 extending from the intervention-side end face of the core unit 24, which, relative to an inboard annular step 36 of the related intervention-side end region of the armature unit 20 is provided in the direction inwards towards the axis 18.

As the detail enlargement of this control region in FIG. 2 illustrates, for a state in which the armature unit is tilted to the right (i.e. in the clockwise sense), both the outward flank of the annular projection 34, and also the inward flank of the annular groove 36, are inclined by a cone angle of approx. 8° relative to the longitudinal axis 18 (whereby in the context of the invention angles between 3° and 40°, preferably between 5° and 20°, more preferably between 7° and 15°, have proved to be beneficial and preferable). In the context of the invention moreover, these cone angles are configured so as to be equal, so that when the armature unit is in a central position (i.e. non-tilted, in contrast to the representation of FIG. 2) the flank angles are matching.

In accordance with the invention the integrally located annular cone-shaped projection 34 is now advantageously configured such that with a typical operating current through the coil unit 12, 14 (i.e. with a magnetomotive force thereby occurring in the region of crossover to the armature unit, in particular in the vertical air gap 40), saturation occurs, if the said air gap (40' in FIG. 2) is very narrow in the left-hand region, as a result of which the magnetomotive force increases in this region and through the related section of the projection 34, whereby, by virtue of the comparatively narrow annular diameter, the saturation primarily occurs here. In accordance with the invention this advantageously leads to the fact, for example, that in the (radially) opposite right-hand region a magnetomotive force increases over the air gap region 40" located there; as a result of the saturation in the left-hand region of the annular projection 34 magnetic flux outside the said region is displaced, i.e. moved.

The result is a compensating force acting along an arrow 42 (FIG. 2); accordingly a force component in the direction transverse (normal) to the longitudinal axis 18 restoring a vertical position, i.e. removing the tilt. In this respect the annular projection 34, here configured specially for the causation of the saturation as a profile section of the core unit, forms the basis for a regulating, i.e. compensating, system with regard to the transverse forces to be overcome or moderated in accordance with the object of the invention. In contrast the comparative example of FIG. 4, with a core-side profile section 44 and a related armature-side annular step 46, illustrates that—as determined by a larger effective flux cross-section of the section 44—at operating conditions (typical operating current for the coil unit) no saturation occurs in the section 44; consequently a magnetic flux concentration occurs in the vertical air gap between the sections 44, 46 in the smallest, tilted space, and also sits stably in this position. Disadvantageous severe frictional forces are here the consequence.

The following Table 1 illustrates the numbers:

| Variant | Air gap between armature and core [mm] | Force X-axis [N] | Force Y-axis [N] | Force Z-axis [N] |
|---|---|---|---|---|
| FIG. 4 | 0.15 | −1.18 | 0.00 | 50.27 |
| FIG. 1 | | 0.71 | 0.05 | 62.40 |
| FIG. 4 | 0.8 | −1.94 | −0.05 | 36.80 |
| FIG. 1 | | −0,.63 | −0.03 | 42.65 |

In conjunction with FIG. 5, the comparison of the force-path characteristics of FIGS. 1, 4 shows how the disadvantageous transverse force can effectively be reduced; the measured data in Table 1 here derive from a three-dimensional simulation with an armature inclination using the positions A to H in FIG. 2. It becomes apparent that (with an armature inclination in the direction of the X-axis) a reduction of the armature transverse force of approx. 30%, i.e. a magnetic force restoring a vertical position (positive sign) can be achieved, and in fact with both a short, and also a relatively long armature stroke (0.15 mm and 0.8 mm), in a direct comparison of the cone configuration of FIG. 1 relative to that in the comparative example of FIG. 4.

The present invention is not limited to the particular configuration shown, rather there are numerous routes and options within the context of the present invention to design the control region by means of suitable profiling of the cone-side and also the armature-side end sections. Here, for example, the contour of FIG. 2 (in which the annular projection on the core side is located radially inwards) can be reversed, in exactly the same way as profiling appropriately optimised for rapid magnetic saturation can be present on the armature side (or both sides). In the present example of embodiment of FIGS. 1, 2 moreover an outboard annular step 50 running around the end face and the peripheral surface has been shown to be advantageous, since by means of the latter disadvantageous friction on the surrounding armature guide can additionally be reduced.

The invention claimed is:

1. An electromagnetic actuation device comprising:

an armature unit movable in an axial direction by a movement stroke relative to a stationary core unit, and as a reaction to an energization of a coil unit with an operating current;

the armature unit axially at one end interacts magnetically with the core unit over a control region axially overlapping at least partially along the movement stroke;

the control region has a first profile section as a section of the armature unit, and has a second profile section as a section of the core unit, with an air gap formed between the first and second profile sections, the air gap extends at right angles to the axial direction; and an effective flux cross-section of the first and the second profile sections for a magnetic flux, flowing across the air gap, of the energisation with the operating current, is configured such that as a reaction to a reduction of the air gap extension caused by tilting and/or deflection of the armature unit from the axial direction a magnetic flux resistance of the first and/or second profile section increases in the region of the reduction and causes a force on the armature unit in the opposite direction to the tilting and/or deflection, wherein the armature unit has a cone-shaped, inboard annular step to form the first profile section.

2. The device in accordance with claim 1, wherein the armature unit and the core unit are designed to be radially symmetrical about a central axis running along the axial direction, and the first and/or the second profile sections are located integrally on an armature and/or core body and are of a radial peripheral design, wherein the radially peripheral air gap between the first and the second profile section as a result of the tilting or deflection experiences a reduction in a first air gap region, and an enlargement in a second air gap region, located opposite with reference to the central axis.

3. The device in accordance with claim 1, wherein the first and/or the second profile section in longitudinal section has a tooth or cam profile, which in the case of a radially symmetrical design of the armature unit and core unit is designed as an axial annular projection.

4. The device in accordance with claim 1, wherein the first and the second profile section bound the air gap by means of cone-shaped wall sections inclined relative to the axial direction.

5. The device in accordance with claim 4, wherein a cone angle of the wall sections of the first and/or second profile section is designed such that, in the case in which the armature unit is in a non-tilted, central position, the wall sections run parallel to one another, and/or an angle formed between the wall sections is less than 5°.

6. The device in accordance with claim 1, wherein one of the profile sections is designed as a radially peripheral annular projection, cone-shaped in longitudinal section, which interacts with the other profile section designed as a radially peripheral, a cone-shaped, an annular groove and/or an annular step.

7. The device in accordance with claim 1, wherein the armature unit on a peripheral surface forms a further peripheral annular step pointing towards the core unit.

8. The device in accordance with claim 1, wherein the armature unit has a cylindrical armature body without a plunger guide or plunger mounting, and/or on a peripheral surface is mounted without a sliding film.

9. The device in accordance with claim 1, wherein the armature unit is connected to a valve device for controlling fluid flow.

10. The device in accordance with claim 1, wherein a cone angle of the wall sections of the first and/or second profile section is designed such that, in the case in which the armature unit is in a non-tilted, central position, the wall sections run parallel to one another, and/or an angle formed between the wall sections is less than 3°.

11. The device according to claim 1, wherein the cone-shaped, inboard annular step is inclined away from the longitudinal axis such that spacing of the cone-shaped, inboard annular step from the longitudinal axis increases in a direction from the armature unit toward the stationary core unit.

12. The device according to claim 1, wherein the second profile section faces radially outwardly and is substantially parallel to the first profile section.

13. The device according to claim 1, wherein each of the first and second profile surfaces is defined by first segments extending substantially perpendicular to the axial direction, second segments extending generally axially from the first segments, and third segments extending from the second segments substantially perpendicular to the axial direction.

14. A method for the operation of an electromagnetic actuation device comprising:

an armature unit movable in an axial direction by a movement stroke relative to a stationary core unit, and as a reaction to an energization of a coil unit with an operating current;

the armature unit axially at one end interacts magnetically with the core unit over a control region axially overlapping at least partially along the movement stroke;

the control region has a first profile section as a section of the armature unit, and has a second profile section as a section of the core unit, with an air gap formed between the first and second profile sections, the air gap extends at right angles to the axial direction; and an effective flux cross-section of the first and the second profile sections for a magnetic flux, flowing across the air gap, of the energization with the operating current, is configured such that as a reaction to a reduction of the air gap extension caused by tilting and/or deflection of the armature unit from the axial direction a magnetic flux resistance of the first and/or second profile section increases in the region of the reduction and causes a force on the armature unit in the opposite direction to the tilting and/or deflection, wherein the armature unit has a cone-shaped, inboard annular step to form the first profile section; the method comprising the steps of:

(a) energisation of the coil unit to effect a movement of the armature unit in the axial direction; and (b) effectuation of a force countering a tilt or deflection from the axial direction in the event of an axial overlap between the armature unit and core unit in the control region.

* * * * *